US005988644A

United States Patent [19]

Cyrkiel

[11] Patent Number: 5,988,644

[45] Date of Patent: Nov. 23, 1999

[54] METHOD OF PLAYING A CARD GAME

[76] Inventor: Michael Cyrkiel, 8033 Beech Ave., Munster, Ind. 46321

[21] Appl. No.: 09/261,699

[22] Filed: Mar. 3, 1999

Related U.S. Application Data

[63] Continuation-in-part of application No. 09/080,977, May 19, 1998.

[51] Int. Cl.[6] ..... A63F 1/00

[52] U.S. Cl. ..... 273/292

[58] Field of Search ..... 273/292, 274, 273/309; 463/12

[56] References Cited

U.S. PATENT DOCUMENTS 5,454,570 10/1995 Karal ..... 273/292

5,549,300 8/1996 Sardarian ..... 273/292

5,743,532 4/1998 Lafferty ..... 273/292

*Primary Examiner*—Benjamin H. Layno

*Attorney, Agent, or Firm*—Leonard Weiss

[57] ABSTRACT

After a player makes a wager, a dealer deals a hand comprised of two cards face up to the player and a hand comprised of two cards face down to himself. When the player's hand has a point value of 20, the player has an option of accepting a guarantee of a payout. When the option is accepted and the dealer's hand is not a natural, a payout that is preferably equal to one half of the wager is given to the player. When the option is accepted and the dealer's hand is a natural, a guarantee payout that is preferably equal to either one to one or a three to two on the wager is given to the player.

5 Claims, 1 Drawing Sheet

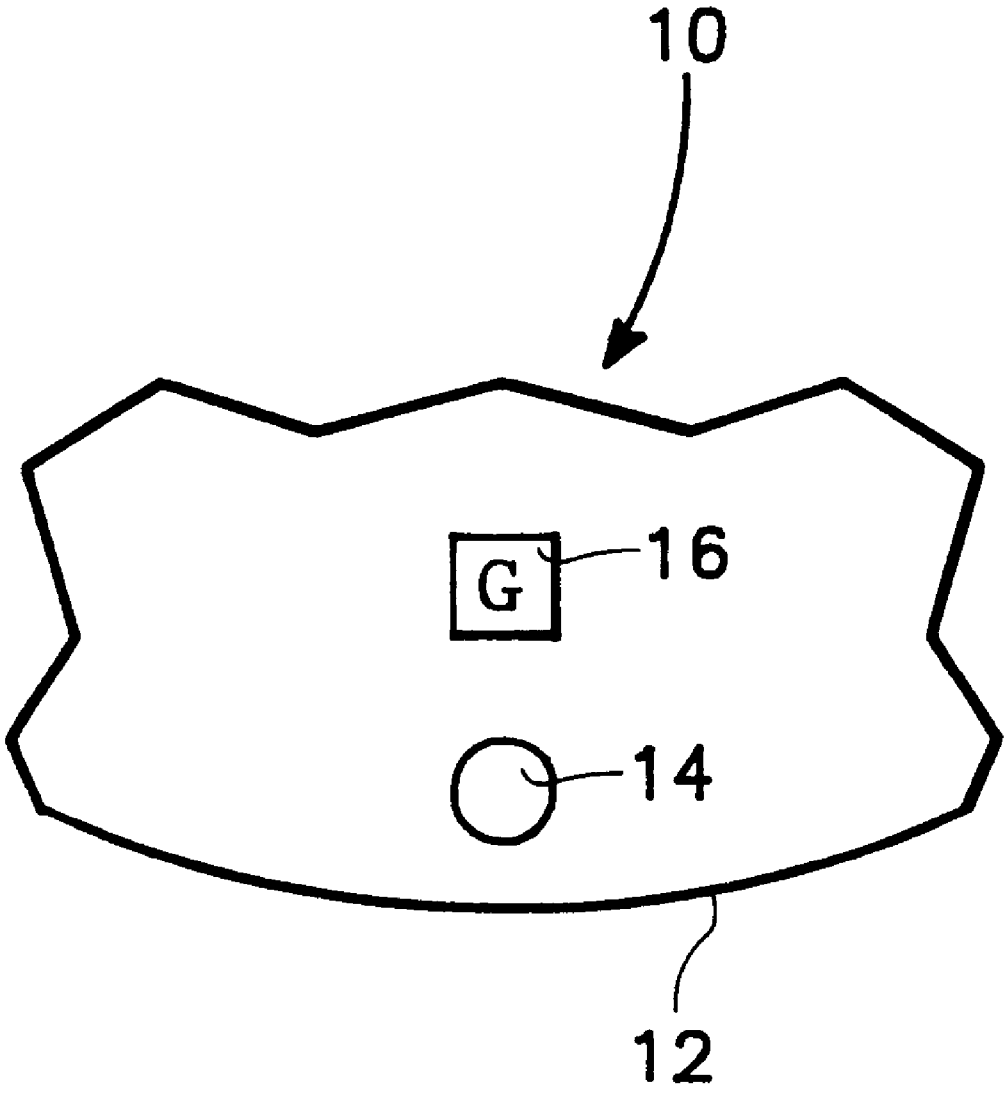
10
G
16
14
12

METHOD OF PLAYING A CARD GAME

This is a continuation-in-part of patent application Ser. No. 09/080,977, filed on May 19, 1998.

BACKGROUND OF THE INVENTION

1. Field of Invention

This invention is in the general field of casino gaming and, more particularly, relates to the game of Black Jack.

2. Description of the Prior Art

Black Jack is the most widely played card game in casinos. The game utilizes a table with a semi-circular top that has a green felt covering which carries images of seven player stations spaced along the table top's arcuate edge. A dealer is usually seated adjacent to the straight edge of the table top.

As many as seven players or as few as one player may play at the table adjacent to a player station. Accordingly, each player has an exclusive access to one of the stations.

The game is played with six to eight standard decks of cards. Each card has a point value. An ace has a point value of either 1 or 11. Kings, queens and jacks have a point value of 10. All other cards have a point value equal to their nominal value. The cards are shuffled together and dealt from a shoe by the dealer.

Each station includes an image of a circle. Before any cards are dealt, each player makes a wager by placing cheques representative of the wager within the circle at the player's station. After the wagers are made, the dealer deals a first card face up to each of the players and to himself. The dealer then deals a second card face up to each of the players and a second card face down to himself whereby each of the players and the dealer have a hand comprised of two cards. The dealer's second card is usually referred to as a hole card.

A point value of a hand is the sum of the point values of cards comprising the hand. It should be understood that the player's object is to acquire a hand whose point value is as close to 21 as possible, without exceeding 21. When the point value of the player's hand exceeds 21, the player loses his wager.

When the dealer's first card has a point value of 10 or is an ace, the dealer must look at the hole card. When sum of the point values of the dealer's first card and hole card is 21 (referred to as a natural), he announces the words, "Twenty-one" or "Black Jack". When a player has a natural he makes a similar announcement.

When the dealer and the player both have naturals, there is no payout; the player retrieves the wager. When the dealer has a natural and the player does not have a natural, the dealer collects the wager. When the dealer does not have a natural and the player has a natural, the player usually receives a 3 to 2 payout on the wager.

When the dealer's hand is not a natural and a player's hand has a point value of less than 21, the player may elect to have his hand augmented by one or more additional cards. Thereafter, a player who has a hand with a point value of 21 or less is referred to as a surviving player.

After the player's have made their election, the dealer exposes his hole card. When the dealer's hand has a point value of 16 or less, the dealer must continue to augment his hand with additional cards until the point value of the dealer's hand is greater than 16. When the dealer's final hand has a point value greater than 21, the dealer is said to have busted and makes a one to one payout on the wager of each of the surviving players.

The dealer may not augment his hand when it has a point value greater than 16. In other words, when the dealer's hand has a point value in a range of 17 to 21, it is the dealer's final hand.

Each of the surviving players win a one to one payout on their wager when they have a hand with a point value greater than the point value of the final hand. Conversely, each of the surviving players lose their wager when they have a hand with a point value less than the point value of the final hand. A surviving player recovers his wager when he has a hand with a point value equal to the point value of the final hand.

One frustrating aspect of play that a player must endure is having a hand comprised of two cards with a point value of 20 and losing because the dealer has a natural.

SUMMARY OF THE INVENTION

An object of the present invention is to provide an option to a player of being guaranteed a payout to a player having a hand comprised of two cards with a known point value in a Black Jack game.

According to the present invention, in a variation of Black Jack, after a player makes a wager, a dealer deals a hand of two cards to a player and a hand of two cards face down to himself. When the player's hand has a known point value, the player has an option of accepting a guarantee of a payout. When the guarantee is accepted and the dealer does not have a natural, the player receives a payout equal to a portion of the wager. When the guarantee is accepted and the dealer has a natural, the player receives a guarantee payout.

The present invention provides a player with an alternative to conventional play of a hand when the players hand is comprised of two cards that have a known point value.

Other objects, features, and advantages of the invention should be apparent from the following description of the preferred embodiment thereof as illustrated in the accompanying drawing.

BRIEF DESCRIPTION OF THE DRAWING

The sole FIGURE herein is a plan view of a player station on a covering of the top of a Black Jack table.

DESCRIPTION OF THE PREFERRED EMBODIMENT

As shown in the drawing, an image of a player station 10 is one of a plurality if images of player stations carried on a green felt covering of the top a semicircular Black Jack table. More particularly, the stations are evenly spaced adjacent to an arcuate edge 12 of the table. A player (not shown) is seated adjacent to the station 10. Other players may be similarly seated adjacent to respective player stations. A dealer (not shown) is seated adjacent to a straight edge (not shown) of the table.

The image includes a circle 14 wherein cheques representative of a wager are placed by the player prior to cards being dealt by the dealer. Cheques are correspondingly placed by other players.

After the cheques are placed, the dealer deals a hand comprised of two cards face up to each player and a hand comprised of two cards face down to himself. The cards are dealt from a shoe containing six to eight standard decks of cards that are shuffled together.

When the player's hand has point value of 20, the player has an option of accepting a guarantee of a payout by moving the cheques from the circle 14 to the interior of a square 16 of the player station 10. An image of the letter, G, is carried within the square 16. All other players have a similar option.

After the option is either accepted or declined, the dealer turns one of his cards face up whereby the dealer's hand is comprised of one card face up and a hole card. The dealer examines the hole hard to determine whether his hand is a natural.

When the player accepts the option and the dealer's hand is not a natural, a payout equal to a portion of the wager is returned to the player and the player's cards are collected by the dealer. Preferably, the portion is one half of the wager.

When the player accepts the option and the dealer's hand is a natural, the dealer gives the player a guarantee payout and the player's cards are collected by the dealer. Preferably, the guarantee payout is either one to one or three to two on the wager.

It should be understood that the acceptance of the option by any other player is handled in a manner similar to that described hereinbefore.

After the dealer has collected the cards of all players who accepted the option, the game proceeds for other players in the manner of the prior art.

Thus there is described herein a variation of black Jack where a player has an option of being guaranteed a payout when a hand formed by the first two cards dealt to the player has a point value of 20.

I claim:

1. A method of playing a variation of Black Jack where a player makes a wager before cards are dealt by a dealer, comprising the steps of:

said dealer dealing a hand of two cards face up to said player;

said dealer dealing a hand of two cards face down to himself;

giving said player an option of accepting a guarantee of a payout only if said player's two card hand has a predetermined point value;

giving to said player a payout equal to a portion of said wager when said player accepts said option and said dealer's hand is not a natural;

giving said player a guarantee payout when said player accepts said option and said dealer's hand is a natural; and collecting said player's cards after a payout is made.

2. The method of claim 1 wherein said predetermined point value is 20.

3. The method of claim 1 wherein said portion is one half of said wager.

4. The method of claim 1 wherein said guarantee payout is one to one on said wager.

5. The method of claim 1 wherein said guarantee payout is three to two on said wager.

* * * * *